US005287640A

United States Patent [19]

Morgan

[11] Patent Number: 5,287,640

[45] Date of Patent: Feb. 22, 1994

[54] EXCESS MATERIAL SUPPORTING STRAP FOR CRAFT FRAME

[76] Inventor: Robert E. Morgan, 2255 NE. Porter Rd., Blue Springs, Mo. 64014

[21] Appl. No.: 898,129

[22] Filed: Jun. 12, 1992

[51] Int. Cl.[5] ..... D06C 3/08; D05C 1/02

[52] U.S. Cl. ..... 38/102.2; 38/102.91; 24/442

[58] Field of Search ..... 38/102, 102.1, 102.2, 38/102.4, 102.91; 160/349.1, 368.1, 380, 384, 399, 401, 402; 211/180; 114/104, 108; 24/31 V, 68 E, 442, 163 R, 182; 292/19, 80, 87, DIG. 38

[56] References Cited

U.S. PATENT DOCUMENTS

| | | | |
|---|---|---|---|
| 89,427 | 4/1869 | Odell | 242/67.3 R |
| 436,231 | 9/1890 | Furman | 114/104 |
| 471,793 | 3/1892 | Irish | 242/67.3 R |
| 566,049 | 8/1896 | Wolford | 242/67.3 R |
| 599,092 | 2/1898 | Barron | 242/67.3 F |
| 730,826 | 6/1903 | Howden | 38/102.2 |
| 730,827 | 6/1903 | Howden | 38/102.2 |
| 758,322 | 4/1904 | Krause | 26/70 |
| 1,163,378 | 12/1915 | Shore | 242/67.3 F |
| 1,571,113 | 1/1926 | French | 24/68 E |
| 1,951,246 | 12/1933 | Kirkpatrick | 38/102.2 |
| 2,003,397 | 5/1935 | Knutson | 45/24 |
| 2,569,337 | 8/1949 | Rice | 45/24 |
| 3,461,511 | 8/1969 | Perina | 24/31 V |
| 4,343,103 | 8/1982 | Murashima | 38/102 |
| 4,503,797 | 3/1985 | Maurin | 114/104 X |
| 4,590,695 | 5/1986 | McGillivray | 38/102.2 |
| 4,658,522 | 4/1987 | Kramer | 160/402 X |
| 4,862,563 | 9/1989 | Flynn | 24/442 |
| 4,963,410 | 10/1990 | Bryant | 24/163 R X |
| 5,025,848 | 6/1991 | Prochaska | 160/368.1 |

FOREIGN PATENT DOCUMENTS

| | | | |
|---|---|---|---|
| 0229636 | 7/1987 | European Pat. Off. | 38/102 |

*Primary Examiner*—Clifford D. Crowder
*Assistant Examiner*—Ismael Izaguirre
*Attorney, Agent, or Firm*—Litman, McMahon & Brown

[57] ABSTRACT

A fabric holding device adapted to support excess material extending below a craft frame or work surface generally comprises a length of flexible and elastic material such as an elastic cord or strip. Fasteners are secured to a first and second end of the length of flexible and elastic material for securing the first and second ends to first and second frame members of the craft frame. The length of flexible and elastic material extends below and around the excess material so as to support the excess material extending below the craft frame.

4 Claims, 2 Drawing Sheets

EXCESS MATERIAL SUPPORTING STRAP FOR CRAFT FRAME

BACKGROUND OF THE INVENTION

1. Field of the Invention

The present invention generally relates to devices for holding and supporting excess material extending over and beyond the edges of a craft type frame.

2. Background Information

Numerous shapes, sizes and styles of craft frames have previously been developed to facilitate handling of a piece of material being worked on by a craft practitioner. These frames are generally designed to pull taught the craft material to facilitate sewing, stitching and other detail work. The excess material which is not pulled taught by the craft frame generally hangs loose below the frame. The loose, excess material tends to drag on the floor and becomes soiled and dirty or interferes with sewing and stitching.

Devices have been developed for holding or supporting the excess material extending below an embroidery hoop. However these devices are not readily useable with different sizes and styles of craft frames for supporting the excess material extending below these frames. Additionally, these devices are not adapted for use in supporting excess material extending below a planar surface such as a table top for a sewing table.

SUMMARY OF THE INVENTION

The present invention comprises a fabric holding device adapted to support excess material extending below a craft frame or work surface. The fabric holding device generally comprises a length of flexible and elastic material such as an elastic cord or strip. Fastening means such as hooks are secured to a first and second end of the length of flexible and elastic material for securing the first and second ends to first and second frame members of the craft frame. The length of flexible and elastic material extends below and around the excess material so as to support the excess material extending below the craft frame.

In one embodiment of the present invention, the fabric holding device includes secondary fastening means for securing the ends of the flexible and elastic material directly to opposite sides of the excess material such that the flexible material extends below and around the portion of excess material extending therebelow so as to support this excess material. The secondary fastening means may comprise pins adapted to cooperate with apertures extending through the hooks such that the hooks may be positioned on opposite sides of the excess material and the pins inserted through the apertures in the opposingly positioned hooks and the excess material extending therebetween.

In another embodiment of the present invention one end of the flexible and elastic material is fixedly secured to a first craft frame member and the other end is removably secured to a second craft frame member which cooperates with the first craft frame member for securing the craft material therebetween such that excess material extends therebelow.

Therefore it is an object of the present invention to provide a device for use in supporting off of the floor excess material from a craft item being worked on by a craft practitioner; to provide such a device that may be used to support excess material extending below various types of craft frames or work surfaces; to provide such a device that is removably securable to and selectively positionable on a craft frame; to provide such a device that is adapted to support varying amounts of excess material; to provide such a device that is relatively inexpensive to manufacture, easy to use, and particularly well adapted for its intended use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
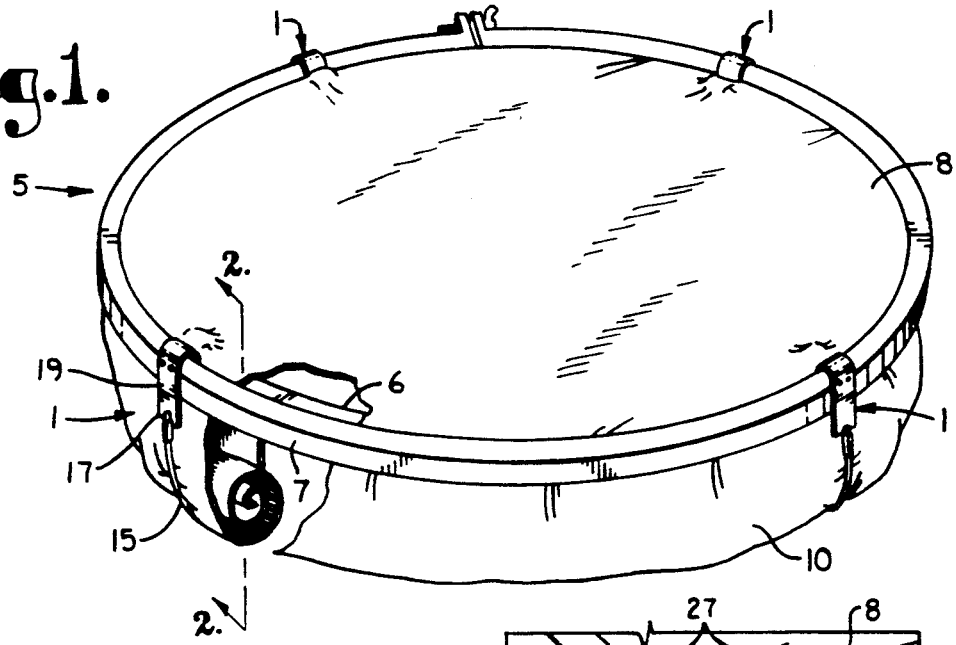
FIG. 1 is a perspective view with portions broken away of fabric holding devices of the present invention shown secured to an embroidery hoop and supporting excess material extending below the embroidery hoop.
Figure 2:
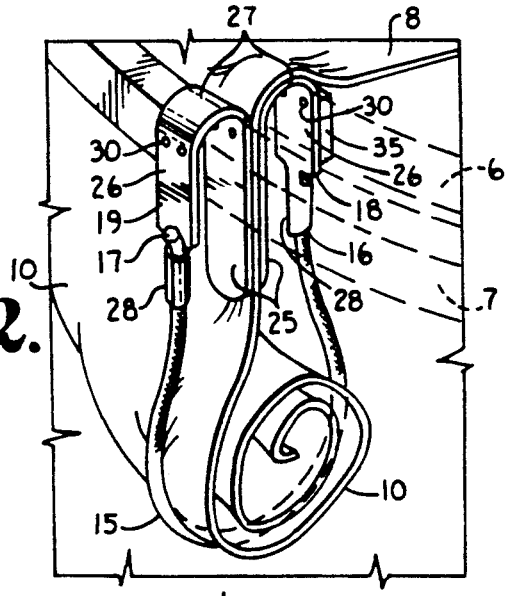
FIG. 2 is an enlarged and fragmentary perspective view generally taken along line 2—2 of FIG. 1.

Referring to the drawings in more detail, the reference numeral 1 generally refers to a fabric holding device of the present invention. FIGS. 1 and 2 show fabric holding devices 1 of the present invention secured to an embroidery hoop 5 type craft frame. The embroidery hoop 5 comprises an inner frame structure or inner hoop 6 and a securement member or outer hoop 7. A section of craft material 8 to be worked on by a user of the embroidery hoop 5 is positioned over the inner hoop 6 and secured in place by the outer hoop 7 such that excess material 10 extends between the inner hoop 6 and the outer hoop 7 and also extends below the inner hoop 6 and the outer hoop 7.

The fabric holding device 1 generally comprises a length of flexible and elastic material such as an elastic strip or elastic cord 15 having a first end 16 and a second end 17. A first hook member 18 and a second hook member 19 are secured to the first end 16 and the second end 17 of the elastic cord 15 and function as first securement means for selectively and removably securing the first and second ends 16 and 17 of the elastic cord 15 to the inner hoop 6 and the outer hoop 7 respectively.

The first and second hook members 18 and 19 are preferably formed from a strip of resilient steel. The steel strip is bent generally in half so as to form a hook portion comprising an inner leg 25, an outer leg 26 and a curved portion 27. A bottom portion 28 of the outer leg 26 of each hook member 18 and 19 is wrapped around or crimped to a respective end 16 and 17 of the elastic cord 15 and functions as fastening means for fastening the ends 16 and 17 of the elastic cord 15 to the first and second hook members 18 and 19 respectively.

Figure 3:
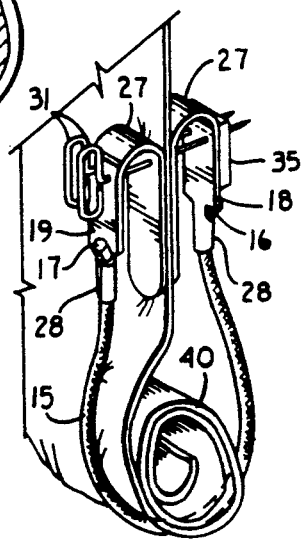
FIG. 3 is a fragmentary, perspective view of the fabric holding device of the present invention secured to a length of excess material extending below a work surface.

The inner leg 25 and the outer leg 26 of each hook member 18 and 19 include two pairs of aligned apertures 30 as shown in FIG. 2 adapted to receive pins 31 as shown in FIG. 3. The first hook member 18 preferably includes a section of foam type material 35 secured to an outer surface 36 of the outer leg 26, so as to extend over the apertures 30 therein. The section of foam type material 3 functions as resistance means for resisting the withdrawal of a pin 3 inserted therethrough.

When the fabric holding device 1 is used for supporting the excess material 10 extending below an embroidery hoop 5, the first and second hook members 18 and 19 of the fabric holding device 1 are selectively and removably positioned on or hooked over the inner hoop 6 and the outer hoop 7 such that the elastic cord 15 extends below and around the excess material 10. The first and second hook members 18 and 19 are positioned on the inner hoop 6 and the outer hoop 7 respectively such that the inner leg 25 of each hook member 18 and 19 is positioned between the inner hoop 6 and the outer hoop 7 and the excess material 10 extends therebetween.

Various numbers of fabric holding devices 1 may be used with an embroidery hoop 5, and the fabric holding devices 1 are selectively positionable on the embroidery hoop such that when excess material 10 extends below the embroidery hoop 5 on one side only, fabric holding devices 1 can be positioned on that side alone. The flexibility and elasticity of the elastic cord 15 allows the fabric holding device 1 to accommodate or support varying quantities of excess material 10.

When the fabric holding devices 1 are used with an embroidery hoop 5 and the hook members 18 and 19 are secured to the inner and outer hoops 6 and 7 of the embroidery hoop 5, the pins 31 are not used.

Figure 4:
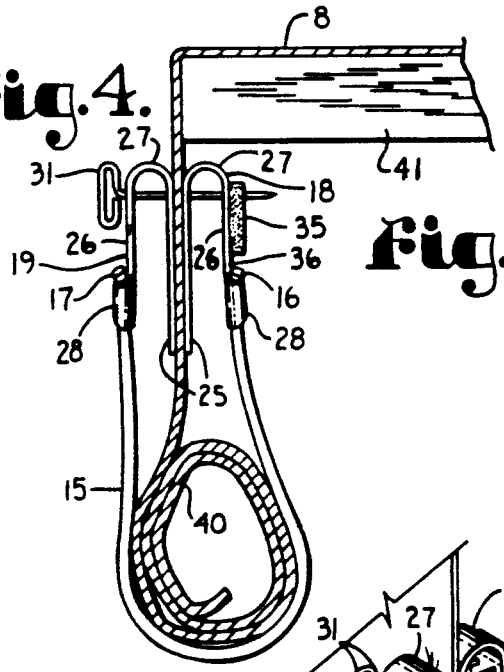
FIG. 4 is an enlarged side elevational view of the fabric holding device of the present invention secured to a length of excess material extending below a table.

FIGS. 3 and 4 show an alternative securement means of the fabric holding device 1 of the present invention wherein the first and second hook members 18 and 19 are shown secured directly onto the excess material 40. The fabric holding device 1 can be used in this manner when the craft material being worked on is supported by a craft frame or surface to which the first and second hook members 18 and 19 cannot be secured. For example, FIG. 4 shows the fabric holding device 1 secured to a section of excess material 40 extending over the edge of a table 41 such as a sewing table.

To secure the fabric holding device 1 to the excess material 40, the inner legs 25 of the first and second hook members 18 and 19 are positioned against opposite sides of the excess material 40 such that the aligned apertures 30 in the first hook member 18 are aligned with the aligned apertures 30 in the second hook member 19. The pins 31 are then inserted through the aligned apertures 30 in the second hook member, through the excess material 40, through the aligned apertures 30 in the first hook member 18 and through the section of foam type material 35 secured to the first hook member 18. When the first and second hook members 18 and 19 are secured to opposite sides of the excess material 40 the elastic cord 15 extends below and supports the excess material 10 extending therebelow.

Figure 5:
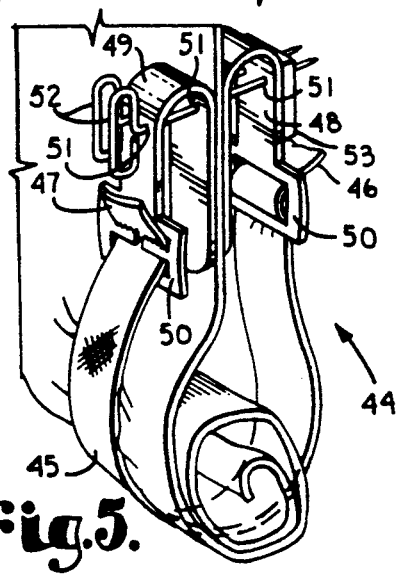
FIG. 5 is an enlarged view similar to FIG. 3 showing an alternative embodiment of the fabric holding device of the present invention.

FIG. 5 shows an alternative embodiment of the fabric holding device 44 of the present invention. The fabric holding device 44 includes an elastic strip 45 having a first end 46 and a second end 47. A first hook member 48 is removably securable to the first end 46 and a second hook member 49 is removably securable to the second end 47. The first and second hook members 48 and 49 include fastening means such as buckles 50 for securing the first and second ends 46 and 47 to the first and second hook members 48 and 49 respectively. The fabric holding device 44 further includes aligned apertures 51 for receiving pins 52 and a section of foam type material 53 secured to the first hook member 48. The fabric holding device 44 is used in the same manner as the fabric holding device 1.

Figure 6:
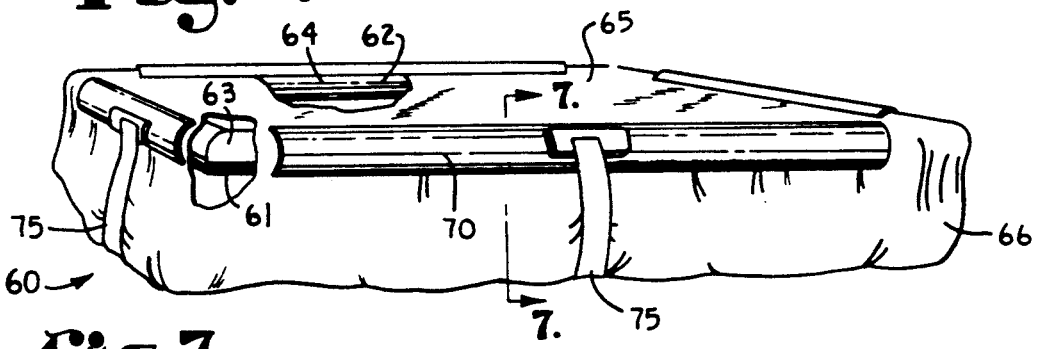
FIG. 6 is a perspective view with portions broken away of fabric holding devices of the present invention shown secured to a rectangular tube-type craft frame and supporting excess material extending below the craft frame.
Figure 7:
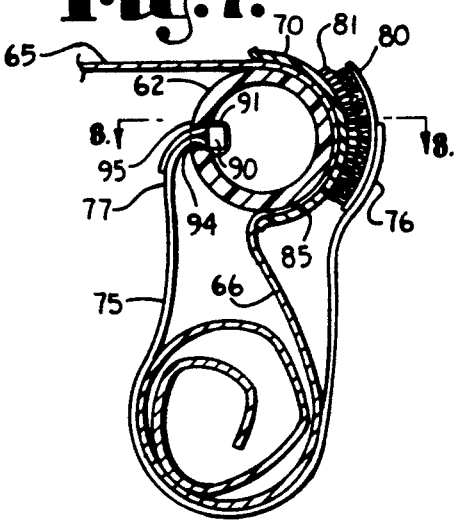
FIG. 7 is an enlarged and fragmentary cross-sectional view taken along line 7—7 of FIG. 6.
Figure 8:
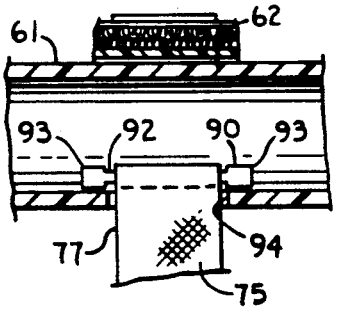
FIG. 8 is an enlarged and fragmentary cross-sectional view of the fabric holding device generally taken along line 8—8 of FIG. 7.

FIG. 6 shows an alternative embodiment of a fabric holding device 60 of the present invention secured to and used with a rectangular tube-type craft frame 61. The craft frame 61 generally comprises four cylindrical tubes 62 secured together with fittings 63 to form a square or rectangular inner frame structure 64. Craft material 65 to be worked on is laid across the inner frame structure 64 such that excess material 66 extends over and below the tubes 62. Flexible C-shaped clamping members or securement members 70 are urged onto the tubes 62 such that the excess material 66 is secured between the clamping members 70 and the tubes 62 and such that the excess material 66 also extends therebelow.

The fabric holding device 60 generally comprises a length of flexible and elastic material such as an elastic strip 75 having a first end 76 and a second end 77. A first cooperating portion 80 of removable fastener such as a hook and loop type fastener sold under the trademark Velcro is fixedly secured to the first end 76. A second cooperating portion 81 of the removable fastener is fixedly secured to an outer surface 85 of a clamping member 70 such that the first end 76 of the elastic strip 75 is removably securable to the clamping member 70 such that the first and second portions 80 and 81 of the removable fastener function as removable securement means.

A bar 90 is fixedly secured to the second end 77 of the elastic strip 75 generally by wrapping the second end 77 of the elastic strip 75 around the bar 90 and sewing the second end 77 to the strip 75 to form a loop 91. The bar 90 includes a central portion 92 around which the elastic strip is wrapped. The bar further includes end portions 93 each having a larger diameter than the diameter of the central portion 92 and which extend beyond the width of the strip 75. The end portions 93 prevent the loop 91 from sliding off the bar 90.

The bar 90 is insertable in a slot 94 formed on an inner surface 95 of one of the tubes 62 forming the frame 61. The bar 90 is longer than the slot 94 such that after the bar 90 is inserted in the slot 94 it is difficult to remove the bar 90 from the slot 94 without removing the second end 77 of the elastic strip 75 from the bar 90. In general, the bar 90 functions as a toggle such that the insertion of the bar 90 within the slot 94 provides fixed attachment of the second end 77 of the elastic strip to the frame 61. The bar 90 generally comprises a first cooperating portion and the slot 94 generally comprises a second cooperating portion of fixed securement means for fixedly securing the second end 77 of the elastic strip 75 to the frame 61. It is foreseen that the first cooperating portion may comprise alternative embodiments. In particular, the first cooperating portion may comprise a spring biased two pronged hook (not shown) secured to the second end 77 of the elastic strip. The two prongs of the hooks are opposingly directed. The prongs may be biased toward one another to allow insertion of the hook within the slot 94. The prongs are then allowed to bias away from one another into the tube such that a portion of each prong extends beyond the edges of the slot 94 and prevents removal of the hook until the two prongs are biased together again.

In use, with the second end 77 of the elastic strip 75 fixedly secured to the frame 61, the elastic strip 75 is wrapped below and around the excess material 66 secured to the frame 61 by clamping member 70, and the first end 76 of the elastic strip 75 is then secured to the clamping member 70 by securing the first cooperating portion 80 on the first end 76 to the second cooperating portion 81 on the clamping member 70. The elastic strip 75 supports the excess material off of the ground and out of the way of the user of the frame 61.

Figure 9:
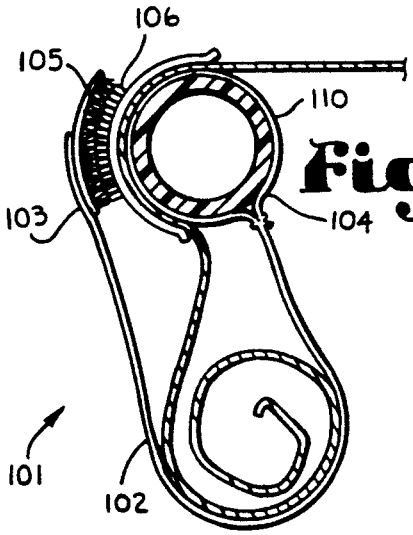
FIG. 9 is a view similar to FIG. 7 showing an alternative embodiment of the fabric holding device of the present invention.

FIG. 9 shows an alternative embodiment of a fabric holding device 101 of the present invention. The fabric holding device 101 generally comprises a length of flexible and elastic material such as an elastic strip 102 having a first end 103 and a second end 104. A first cooperating portion 105 of removable fastening means such as a hook and loop type fastener sold under the trademark Velcro is fixedly secured to the first end 103. A second cooperating portion 106 of the removable fastening means is fixedly secured to an outer surface 85 of a clamping member 70 such that the first end 103 of the elastic strip 102 is removably securable to the clamping member 70.

The second end 104 of the elastic strip 102 is fixedly secured to a tube 62 by wrapping the second end 104 around the tube 62 and securing the second end 104 to the elastic strip 102 to form a loop 110 by means such as stitching. The fabric holding device 101 is used in a similar manner as the fabric holding device 60.

Figure 10:
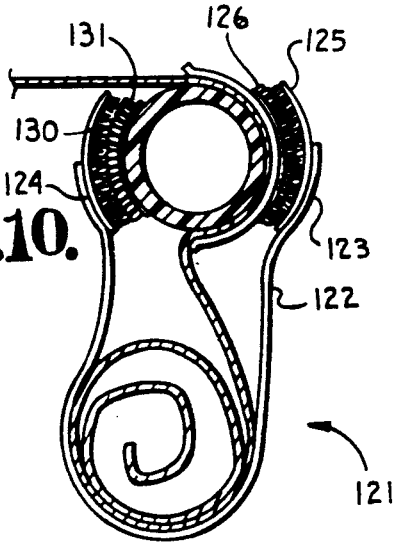
FIG. 10 is a view similar to FIG. 7 showing an alternative embodiment of the fabric holding device of the present invention.

FIG. 10 shows an alternative embodiment of a fabric holding device 121 of the present invention. The fabric holding device 121 generally comprises a length of flexible and elastic material such as an elastic strip 122 having a first end 123 and a second end 124. A first cooperating portion 125 of removable fastening means such as a hook and loop type fastener sold under the trademark Velcro is fixedly secured to the first end 123. A second cooperating portion 126 of the removable fastening means is fixedly secured to an outer surface 85 of a clamping member 70 such that the first end 123 of the elastic strip 122 is removably securable to the clamping member 70.

A first cooperating portion 130 of removable fastening means such as a hook and loop type fastener is fixedly secured to the second end 124 of the elastic strip 122. A second cooperating portion 131 of the removable fastening means is fixedly secured to an inner surface 95 of a tube 62 such that the second end 124 of the elastic strip 122 is removably securable to the tube 62. The fabric holding device 121 is generally used in the same manner as the fabric holding device 60 except that the second end 124 of the elastic strip 122 of the fabric holding device 121 is removably securable to the tube 62.

It is to be understood that while certain forms of the present invention have been illustrated and described herein, it is not to be limited to the specific forms or arrangement of parts described and shown.

What is claimed and desired to be secured by Letters Patent is as follows:

1. A fabric holding device for use with a craft frame comprising a first craft frame member and a second craft frame member and wherein craft material is positioned over said first craft frame member and secured between said first craft frame member and said second craft frame member such that excess material extends below said craft frame; said fabric holding device comprising:

(a) a flexible strip having a first end and a second end;

(b) a first hook member including a hook portion and fastening means for securing said first end of said flexible strip to said first hook member; said hook portion being removably attachable to a first craft frame member;

(c) a second hook member including a hook portion and fastening means for securing said second end of said flexible strip to said second hook member; said hook portion being removably attachable to a second craft frame member.

2. A fabric holding device for use with a craft frame wherein craft material is positioned over an inner frame structure and secured between said inner frame structure and a securement member such that excess material extends below said craft frame; said fabric holding device comprising:

(a) a flexible strip having a first end and a second end;

(b) fixed securement means for fixedly securing said first end of said flexible strip to a first of said inner frame structure and said securement member;

(c) a first portion of a fastener secured to said second end of said flexible strip;

(d) a second portion of said fastener secured to a second of said inner frame structure and said securement member; said first portion being removably securable to said secured portion for removably securing said second end of said flexible strip to said second of said inner frame structure and said securement member.

3. The fabric holding device as disclosed in claim 2 for use with a tube-type craft frame wherein said inner frame structure is formed from hollow tubing and wherein said fixed securement means comprises:

(a) an elongate bar secured to said first end of said flexible strip; said bar insertable within said hollow tubing through an elongate slot in said hollow tube; said bar being longer than said elongate slot so as to resist removal of said bar from said hollow tubing for securing said flexible strip thereto.

4. A fabric holding device for use with a craft frame wherein craft material is positioned over an inner frame structure and secured between said inner frame structure and a securement member such that excess material extends below said craft frame; said fabric holding device comprising:

(a) a flexible strip having a first end and a second end;

(b) first portions of a fastener secured to said first end and said second end of said flexible strip;

(c) second portions of said fastener secured to said inner frame structure and said securement member; said first portions removably securable to said second portions for removably securing said first and second ends of said flexible strip to said inner frame structure and said securement member respectively.

* * * * *